US010927732B2

(12) United States Patent
Strombeck et al.

(10) Patent No.: US 10,927,732 B2
(45) Date of Patent: Feb. 23, 2021

(54) LOW NOISE ENCLOSURE

(71) Applicant: Cummins Power Generation IP, Inc., Minneapolis, MN (US)

(72) Inventors: David W. Strombeck, Plymouth, MN (US); Stephen W. Osmonson, Eagan, MN (US); Sathyanarayanan Arumugam, Shoreview, MN (US); Shashikant Ramdas More, Coon Rapids, MN (US)

(73) Assignee: Cummins Power Generation IP, Inc., Minneapolis, MN (US)

( * ) Notice: Subject to any disclaimer, the term of this patent is extended or adjusted under 35 U.S.C. 154(b) by 514 days.

(21) Appl. No.: 15/938,253

(22) Filed: Mar. 28, 2018

(65) Prior Publication Data

US 2019/0301322 A1 Oct. 3, 2019

(51) Int. Cl.

| | |
|---|---|
| ***F01N 1/08*** | (2006.01) |
| ***F01N 1/10*** | (2006.01) |
| ***F02B 63/04*** | (2006.01) |
| ***F02M 35/12*** | (2006.01) |
| ***G10K 11/162*** | (2006.01) |

(52) U.S. Cl.

CPC ..... *F01N 1/083* (2013.01); *F01N 1/10* (2013.01); *F02B 63/044* (2013.01); *F02M 35/1211* (2013.01); *F02M 35/1272* (2013.01); *G10K 11/162* (2013.01); *F02B 2063/045* (2013.01)

(58) Field of Classification Search

CPC ..... F01N 1/083; F01N 1/10; F02M 35/1211; F02M 35/1272; G10K 11/162; F02B 63/044; F02B 2063/045; F02B 77/13

USPC ..... 181/198, 200, 202, 204, 205

See application file for complete search history.

(56) References Cited

U.S. PATENT DOCUMENTS

| | | | | | |
|---|---|---|---|---|---|
| 3,478,958 | A | * | 11/1969 | Bowen | F04B 39/0038 417/234 |
| 3,930,558 | A | * | 1/1976 | Schnell | B21D 51/2653 181/200 |
| 3,982,600 | A | | 9/1976 | Gerresheim et al. | |
| 3,989,415 | A | * | 11/1976 | Van-Hee | F02B 77/13 417/312 |
| 4,122,353 | A | | 10/1978 | Noguchi | |
| 4,128,769 | A | * | 12/1978 | Bons | F01D 25/30 181/213 |
| 4,733,750 | A | * | 3/1988 | Poirier | F02B 63/04 181/202 |
| 4,753,318 | A | | 6/1988 | Mizuno et al. | |
| 4,835,405 | A | | 5/1989 | Clancey et al. | |
| 5,125,378 | A | | 6/1992 | Westerbeke, Jr. | |
| 5,433,175 | A | | 7/1995 | Hughes et al. | |

(Continued)

*Primary Examiner* — Jeremy A Luks

(74) *Attorney, Agent, or Firm* — Foley & Lardner LLP

(57) ABSTRACT

Systems and apparatuses include an apparatus including an intake defined by an intake aperture, an intake baffle, and an intake floor structured to couple to an intake portion of an enclosure roof, the intake extending along at least eighty percent (80%) of a width of the apparatus on a first side, an exhaust defined by an exhaust aperture, an exhaust baffle, and an exhaust floor structured to couple to an exhaust portion of the enclosure roof, the exhaust extending along at least eighty percent (80%) of the width of the apparatus on a second side opposite the first side, a partition panel isolating the intake from the exhaust, and an engagement mechanism structured to couple the apparatus to a generator set.

15 Claims, 8 Drawing Sheets

(56) References Cited

U.S. PATENT DOCUMENTS 5,642,702 A 7/1997 Kouchi et al.
5,672,052 A * 9/1997 Ishida ..... F04C 29/066 417/312
5,709,175 A * 1/1998 Carroll ..... F01P 11/12 123/41.49
5,806,963 A * 9/1998 Miller ..... F21L 14/04 362/192
5,899,174 A 5/1999 Anderson et al.
6,376,944 B1 4/2002 Grizzle et al.
6,491,133 B2 12/2002 Yamada et al.
6,630,756 B2 10/2003 Kern et al.
6,784,560 B2 8/2004 Sugimoto et al.
6,784,574 B2 8/2004 Turner et al.
7,221,061 B2 5/2007 Alger et al.
7,482,705 B2 1/2009 Piercey, III
7,513,223 B2 * 4/2009 Onodera ..... F01P 11/12 123/41.7
7,597,340 B2 * 10/2009 Hirose ..... B62B 5/0006 16/110.1
8,037,966 B2 10/2011 Errera et al.
8,701,821 B2 * 4/2014 O'Coimin ..... H05K 7/20736 181/224
8,881,694 B2 11/2014 Gillett et al.
8,890,340 B2 * 11/2014 Honkanen ..... F02B 63/044 290/1 A
8,963,348 B2 2/2015 Kawakita et al.
9,429,068 B2 * 8/2016 Hibi ..... F02B 63/04
9,997,977 B1 * 6/2018 Roll ..... H02K 7/1815
10,084,358 B1 * 9/2018 Leedy ..... E06B 7/08
10,697,367 B2 * 6/2020 McAndrew ..... F02B 63/044
2006/0054113 A1 * 3/2006 Yasuda ..... F02B 63/04 123/41.65
2006/0065216 A1 * 3/2006 Sugimoto ..... F01P 5/06 123/41.7
2008/0053746 A1 * 3/2008 Albert ..... F04D 29/663 181/202
2010/0037837 A1 * 2/2010 Yamasaki ..... F02B 63/04 123/41.6
2014/0340846 A1 * 11/2014 Kurita ..... H05K 7/20727 361/695

* cited by examiner

LOW NOISE ENCLOSURE

TECHNICAL FIELD

The present disclosure relates to enclosures for engines, generators, or generator sets. More particularly, the present disclosure relates to systems and methods for reducing noise emissions from a generator set.

BACKGROUND

It is desirable to reduce the noise emission of power generation components such as generator sets including an engine and a generator. Some systems designed to reduce noise emissions includes a secondary noise reducing enclosure and/or increased thickness barriers. Current solutions to reduce noise emissions add weight and cost, and increase the footprint of the generator set.

SUMMARY

One embodiment relates to an apparatus that includes an intake defined by an intake aperture, an intake baffle, and an intake floor structured to couple to an intake portion of an enclosure roof, the intake extending along at least eighty percent (80%) of a width of the apparatus on a first side, an exhaust defined by an exhaust aperture, an exhaust baffle, and an exhaust floor structured to couple to an exhaust portion of the enclosure roof, the exhaust extending along at least eighty percent (80%) of the width of the apparatus on a second side opposite the first side, a partition panel isolating the intake from the exhaust, and an engagement mechanism structured to couple the apparatus to a generator set.

Another embodiment relates to a system that includes an enclosure defining an enclosure width and including a first enclosure wall extending the entire enclosure width, an enclosure intake wall that extends along at least eighty percent (80%) of the enclosure width, an enclosure intake cavity defined between the first enclosure wall and the enclosure intake wall, a second enclosure wall positioned on an opposite side of the enclosure from the first enclosure wall and extending the entire enclosure width, an enclosure exhaust wall that extends along at least eighty percent (80%) of the enclosure width, an enclosure exhaust cavity defined between the second enclosure wall and the enclosure exhaust wall, and a chamber defined between the enclosure intake wall and the enclosure exhaust wall. A modular canopy defines a canopy width that extends along at least eighty percent (80%) of the enclosure width, and including a canopy intake defined by an intake aperture, an intake baffle, and an intake floor structured to couple to the enclosure to provide fluid communication between the intake aperture and the enclosure intake cavity, the canopy intake extending along substantially the entire canopy width adjacent the first enclosure wall, a canopy exhaust defined by an exhaust aperture, an exhaust baffle, and an exhaust floor structured to couple to the enclosure to provide fluid communication between the exhaust aperture and the enclosure exhaust cavity, the canopy exhaust extending along substantially the entire canopy width adjacent the second enclosure wall, and a partition panel isolating the canopy intake from the canopy exhaust.

Another embodiment relates to a method that includes removing a roof of a generator set enclosure, coupling a modular canopy to the generator set enclosure, providing an intake flow path extending along at least eighty percent (80%) of a width of the generator set enclosure through the coupled modular canopy and the generator set enclosure, the intake flow path includes an intake aperture positioned in the modular canopy, an intake baffle positioned in the modular canopy, an intake floor positioned in the modular canopy, and an intake cavity positioned in the generator set enclosure. The method further includes providing an exhaust flow path extending along at least eighty percent (80%) of the width of the generator set enclosure through the coupled modular canopy and the generator set enclosure, the exhaust flow path includes an exhaust aperture positioned in the modular canopy, an exhaust baffle positioned in the modular canopy, an exhaust floor positioned in the modular canopy, and an exhaust cavity positioned in the generator set enclosure. The method further includes separating the intake flow path and the exhaust flow path with a partition panel.

These and other features, together with the organization and manner of operation thereof, will become apparent from the following detailed description when taken in conjunction with the accompanying drawings.

DETAILED DESCRIPTION

Following below are more detailed descriptions of various concepts related to, and implementations of, methods, apparatuses, and systems for a low noise enclosure for a generator set. The various concepts introduced above and discussed in greater detail below may be implemented in any number of ways, as the concepts described are not limited to any particular manner of implementation. Examples of specific implementations and applications are provided primarily for illustrative purposes.

Referring to the figures generally, the various embodiments disclosed herein relate to systems, apparatuses, and methods for a low noise enclosure for a generator set. The enclosure includes a modular canopy that provides a circuitous intake and exhaust path. The modular canopy includes air flow partitions that are formed from sheet metal as thin as two millimeters (2 mm) thick. Air filters, intake silencers, and noise deadening or barrier material can be attached to wall and partition surfaces to further reduce noise emissions. Additionally, lift hooks can be connected to the enclosure within recesses which can be sealed with covers to further reduce noise emission.

Figure 1A:
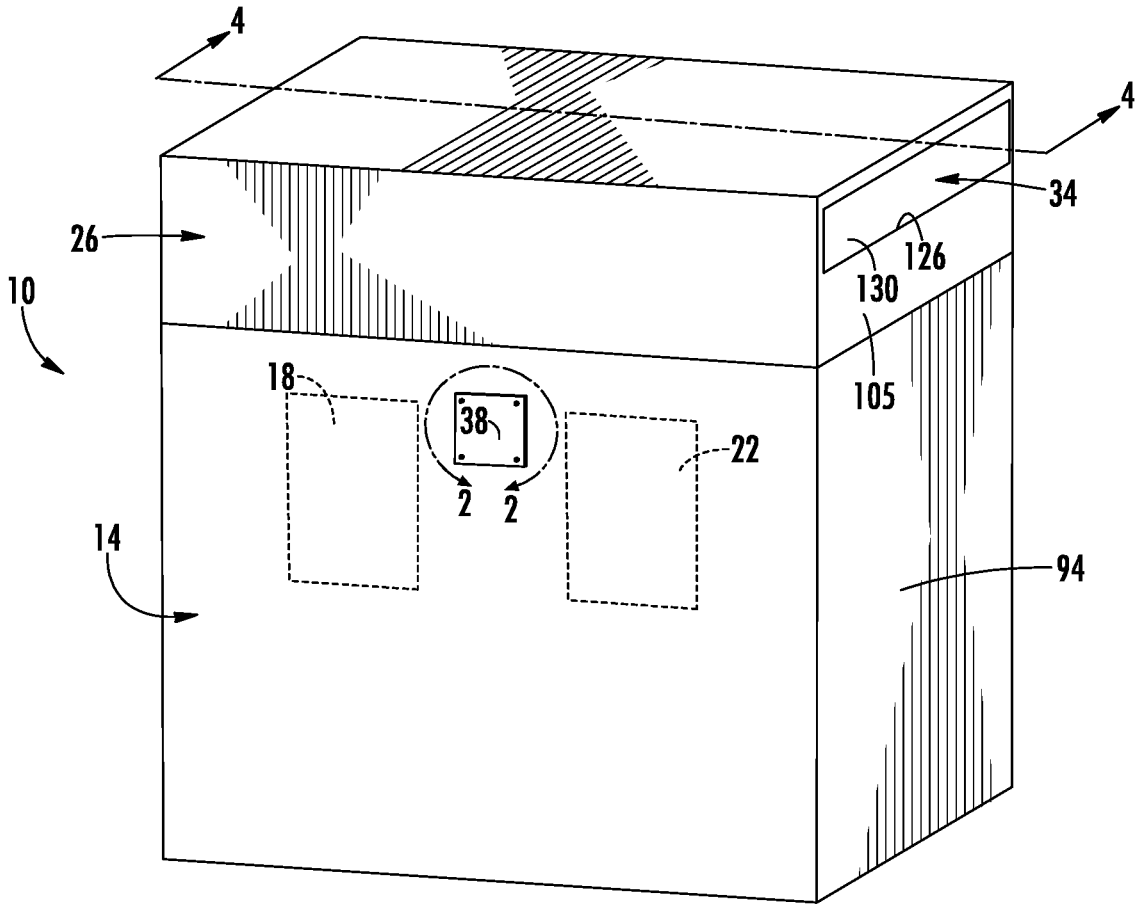
FIG. 1A is a top, front, left perspective view of a generator set according to some embodiments.

As shown in FIG. 1A, a generator set 10 having a low noise enclosure system includes an enclosure 14 that houses an engine 18 and other generator set components 22, and a modular canopy 26 that is coupled to the enclosure 14 and provides an intake 30 (see FIG. 4) and an exhaust 34 for the enclosure 14. The enclosure 14 includes a single point lift access cover plate 38. The generator set 10 includes the intake 30 and the exhaust 34 positioned at opposite ends from one another such that air enters the intake 30, flows through and/or across the engine 18 and generator set components 22, and exits the exhaust 34 in a generally linear direction (e.g., generally left to right in FIG. 1A). It is noted that in some embodiments air flows through the enclosure 14 across the generator set components 22 first (in particular, electrical components, such as an alternator, or generator, or control or connection circuits), and then the engine 18 and any cooling system or radiator (not shown). In other embodiments intake air flows initially through or across the cooling system and engine 18 and then the generator set components 22. In some embodiments, the intake 30 and the exhaust 34 are positioned on the end walls of the modular canopy 26. In some embodiments, the single point lift access cover plate 38 is positioned on a front wall of the enclosure 14.

Figure 1B:
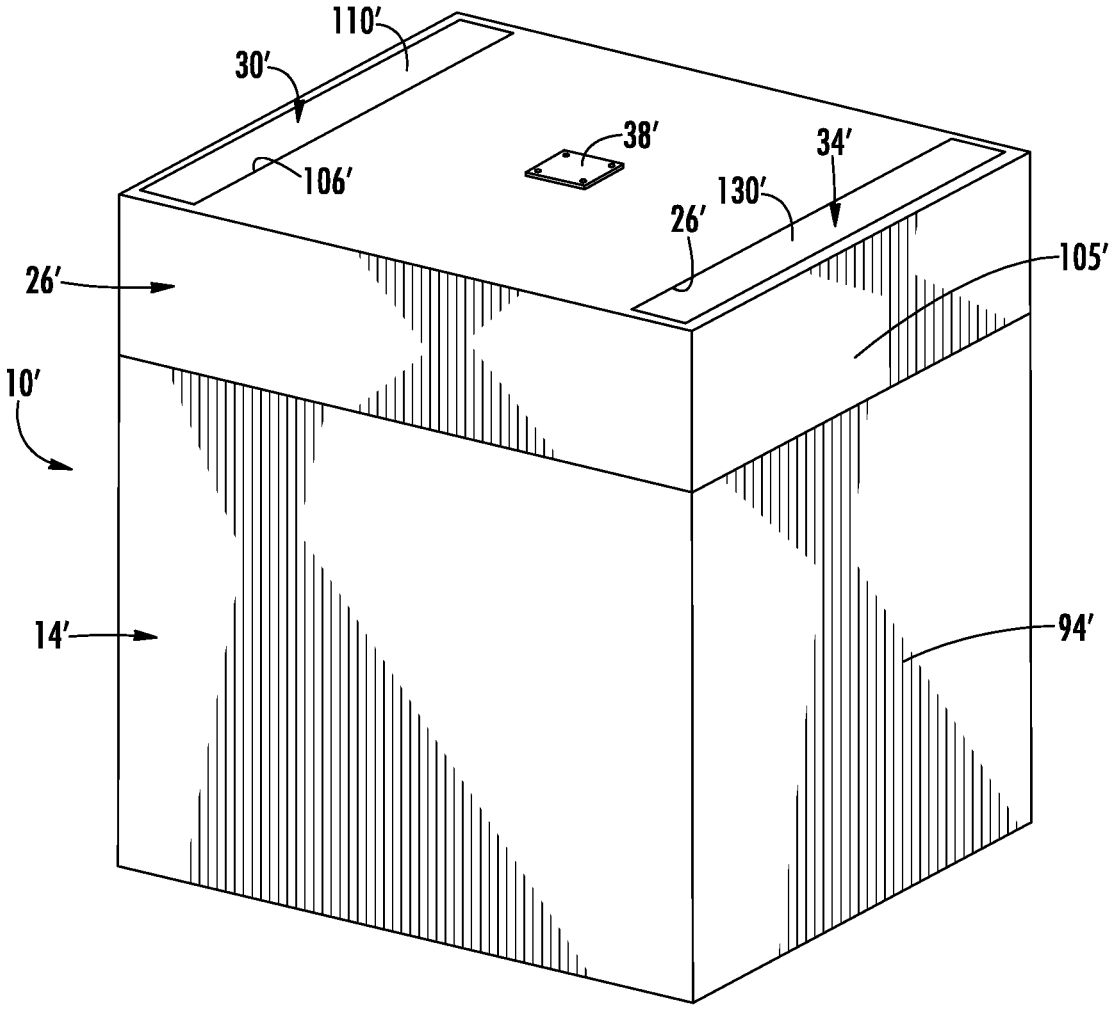
FIG. 1B is a top, front, left perspective view of a generator set according to some embodiments.

As shown in FIG. 1B, a generator set 10' that is similar to the generator set 10 described above with respect to FIG. 1A and labelled with like numbers in the prime series, includes an intake 30' and an exhaust 34' positioned on a top or roof of the modular canopy 26. Additionally, a single point lift access cover plate 38' is positioned on the roof of the modular canopy 26. In some embodiments, the intake 30, 30' and exhaust 34, 34' may be positioned in a combination of side and roof positions. For example, the intake 30, 30' may be positioned on a sidewall, and the exhaust 34, 34' may be positioned on the roof. Similarly, a combination of positions may be utilized for the single point lift access cover plate 38, 38'. In some embodiments, multiple single point lift access cover plates 38, 38' are installed on the generator set 10, 10'.

Figure 2:
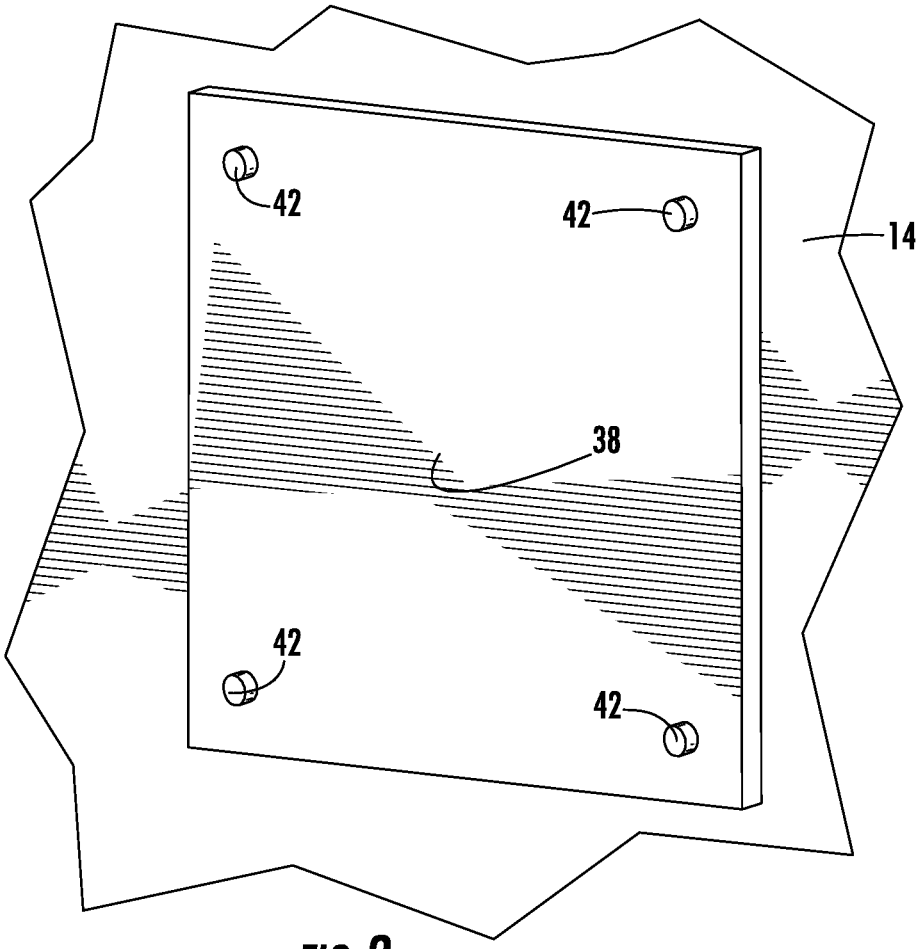
FIG. 2 is a detail view of the generator set of FIG. 1A taken within a line 2-2 of FIG. 1A.
Figure 3:
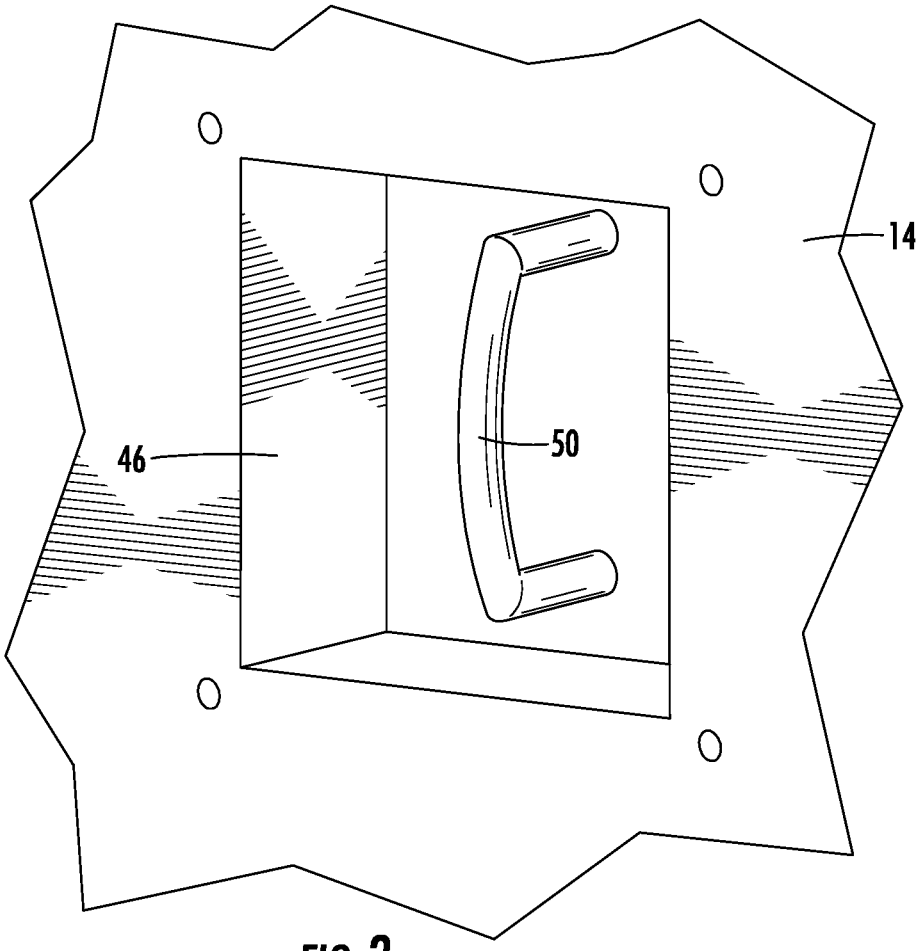
FIG. 3 is a detail view of the generator set of FIG. 1A taken within the line 2-2 of FIG. 1A with a hook cover removed.

As shown in FIG. 2, the cover plate 38 is fastened to the enclosure 14 with four fasteners 42. As shown in FIG. 3, the cover plate 38 can be removed to reveal a lift recess or cavity 46 that is recessed into a side of the enclosure 14. A single point lifting hook or ring 50 is positioned within the cavity 46 and is structured to provide a single point lift feature when the cover plate 38 is removed. The cover plate 38 mitigates noise emission from the lift cavity 46 when installed, which in some embodiments may be in communication with interior spaces or ducting of the enclosure 14. In some embodiments, the cover plate 38 includes a gasket, sealing member, or sound barrier material that further mitigates noise emission from the lift cavity when the cover plate 38 is installed. It is noted that this cover plate 38 and lifting hook 50 arrangement enables the lifting hook 50 to be attached to underlying structural elements or be a part of the enclosure 14 that the modular canopy 26 covers when attached.

Figure 4:
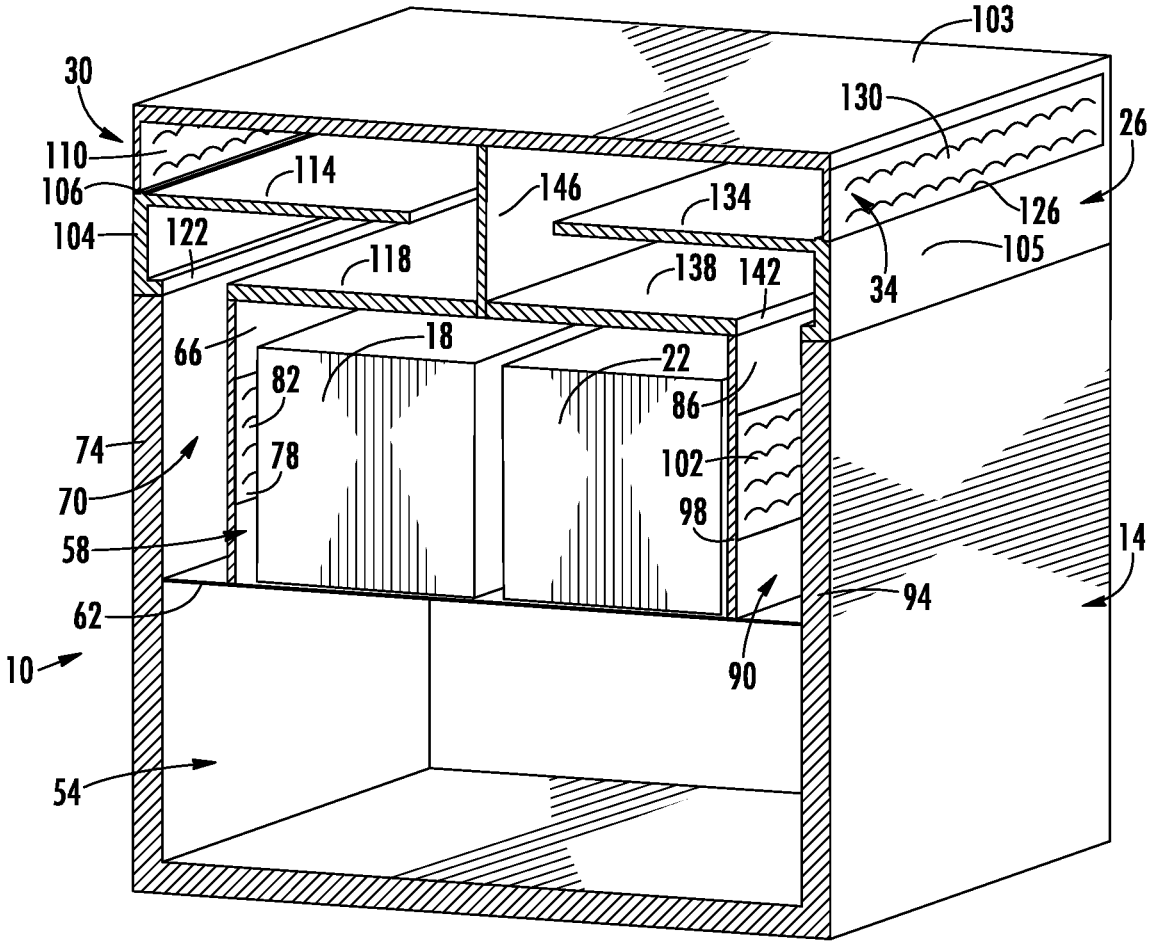
FIG. 4 is section view of the generator set of FIG. 1A taken along a line 4-4 of FIG. 1A.

As shown in FIG. 4, the enclosure 14 further includes a first chamber 54 in a lower portion of the enclosure 14 and a second chamber 58 positioned above and separated from the first chamber 54 by a wall or floor 62. In some embodiments, the first chamber 54 houses fuel or other components for the generator set 10. In some embodiments, the first chamber 54 is eliminated. An enclosure intake wall 66 extends the width of the enclosure 14 and defines an enclosure intake cavity 70 between an outer or back wall 74 and the enclosure intake wall 66. An enclosure intake aperture 78 is defined in the enclosure intake wall 66 and sized to receive an intake manifold, radiator, component, and/or filter 82. Although the filter 82 is shown as an independent component, those of skill in the art will recognize that the filter 82 can be moved, eliminated, or altered to meet the requirements of the engine 18 and components 22. In some constructions, an air intake manifold of the engine 18 is structured to engage or cooperate with the enclosure intake aperture 78 to receive intake air.

An enclosure exhaust wall 86 extends the width of the enclosure 14 and defines an enclosure exhaust cavity 90 between an outer or front wall 94 and the enclosure exhaust wall 86. An enclosure exhaust aperture 98 is defined in the enclosure exhaust wall 86 and sized to receive an exhaust manifold, component, and/or filter 102. Although the filter 102 is shown as an independent component, those of skill in the art will recognize that the filter 102 can be moved, eliminated, or altered to meet the requirements of the engine 18 and components 22. In some constructions, an air exhaust manifold of the engine 18 is structured to engage or cooperate with the enclosure exhaust aperture 98 to expel exhaust gases. Additionally, a combination of engine exhaust and exhausting cooling air may exit the enclosure exhaust aperture 98 and enter the enclosure exhaust cavity 90. Further, additional aftertreatment components or mufflers may be positioned or mounted within the enclosure exhaust cavity 90, the second cavity 58, and/or external to the enclosure 14 and the modular canopy 26, as desired. In some embodiments, sound deadening material or insulation is adhered or otherwise attached to the surfaces of the enclosure exhaust cavity 90 and is selected to reduce noise while standing up to or inhibiting degradation in the high heat environment of the enclosure exhaust cavity 90 (i.e., the insulation used in the enclosure exhaust cavity 90 is heat resistant).

The modular canopy 26 is structured to couple to the enclosure 14 and includes a canopy roof 103, a first or canopy back wall 104, and a second or canopy front wall 105. A canopy intake aperture 106 is defined in the canopy back wall 104 and is sized to receive a canopy intake filter 110 to provide the intake 30. A canopy intake baffle 114 extends substantially horizontally from the canopy back wall 104 adjacent the canopy intake aperture 106. A canopy intake floor 118 is spaced from the canopy intake baffle 114 and defines a canopy intake exit aperture 122 sized to communicate with the enclosure intake cavity 70. In some embodiments, the canopy intake aperture 106, the canopy intake baffle 114, the canopy intake floor 118 and the canopy intake exit aperture 122 all extend substantially the entire width of the modular canopy 26.

A canopy exhaust aperture 126 is defined in the canopy front wall 105 and is sized to receive a canopy exhaust filter 130 to provide the exhaust 34. A canopy exhaust baffle 134 extends substantially horizontally from the canopy front wall 105 adjacent the canopy exhaust aperture 126. A canopy exhaust floor 138 is spaced from the canopy exhaust baffle 134 and defines a canopy exhaust entrance aperture 142 sized to communicate with the enclosure exhaust cavity 90. A partition panel 146 extends substantially the entire width of the modular canopy 26 and separates the intake 30 from the exhaust 34. The canopy exhaust aperture 126, the canopy exhaust baffle 134, the canopy exhaust floor 138, and the canopy exhaust entrance aperture 142 all extend substantially the entire width of the modular canopy 26.

When the modular canopy 26 is installed on the enclosure 14, the canopy back wall 104 sealingly engages the enclosure back wall 74, the canopy intake floor 118 sealingly engages the enclosure intake wall 66, the canopy exhaust floor 138 sealingly engages the enclosure exhaust wall 86, and the canopy front wall 105 sealingly engages the enclosure front wall 94. The intake 30 is provided from the canopy intake aperture 106, across the canopy intake baffle 114 to the partition panel 146, across the canopy intake floor 118 to the canopy intake exit aperture 122, into the enclosure intake cavity 70, and through the enclosure intake aperture 78 to the second chamber 58, the engine 18, and/or one or more components 22. The exhaust 34 is provided from the enclosure exhaust aperture 98 to the enclosure exhaust cavity 90, through the canopy exhaust entrance aperture 142, across the canopy exhaust floor 138 to the partition panel 146, across the canopy exhaust baffle 134, and out the canopy exhaust aperture 126. The partition panel 146 isolates the intake 30 from the exhaust 34.

Figure 5A:
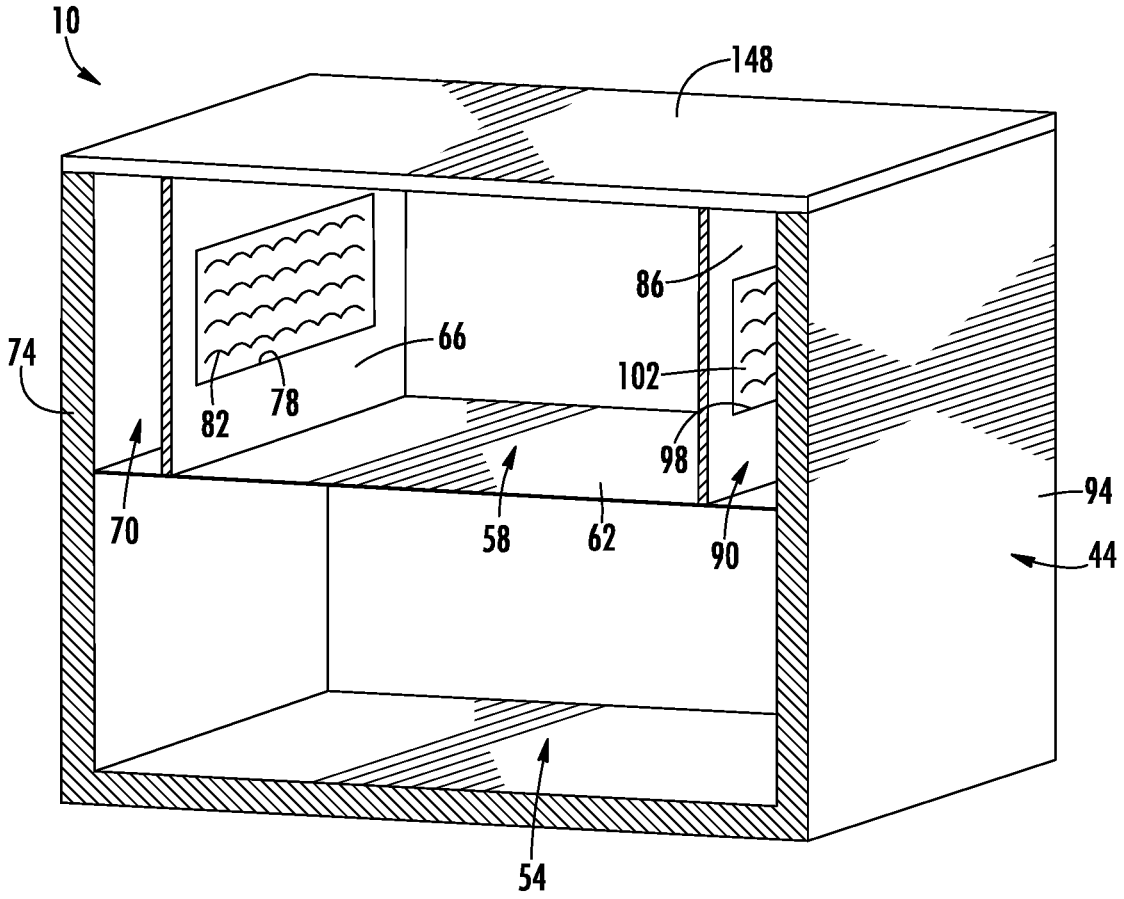
FIG. 5A is a section view of the generator set of FIG. 1A taken along a line 4-4 of FIG. 1A with a roof installed, according to some embodiments.

As shown in FIG. 5A, the enclosure 14 may be packaged with an enclosure roof 148 that is fastened or otherwise fixed to the enclosure 14 to seal the enclosure 14 from environmental elements or damage. In some embodiments, the enclosure roof 148 is maintained in place during shipping or movement of the enclosure 14. In some embodiments, the enclosure roof 148 is removed to allow for installation of the modular canopy 26. In some embodiments, the enclosure roof 148 may be modified to accept and mate with the modular canopy 26. In some embodiments, the enclosure roof 148, front wall 94, or back wall 74, may be cut or otherwise modified to provide access to the enclosure intake cavity 70 and the enclosure exhaust cavity 90. For example, the enclosure roof 148, front wall 94, or back wall 74, may be cut or otherwise modified to allow operation of the generator set 10 in the enclosure 10 as a generator set enclosure without the modular canopy 26, or allowing the modular canopy 26 to be retrofitted at a later date.

Figure 5B:
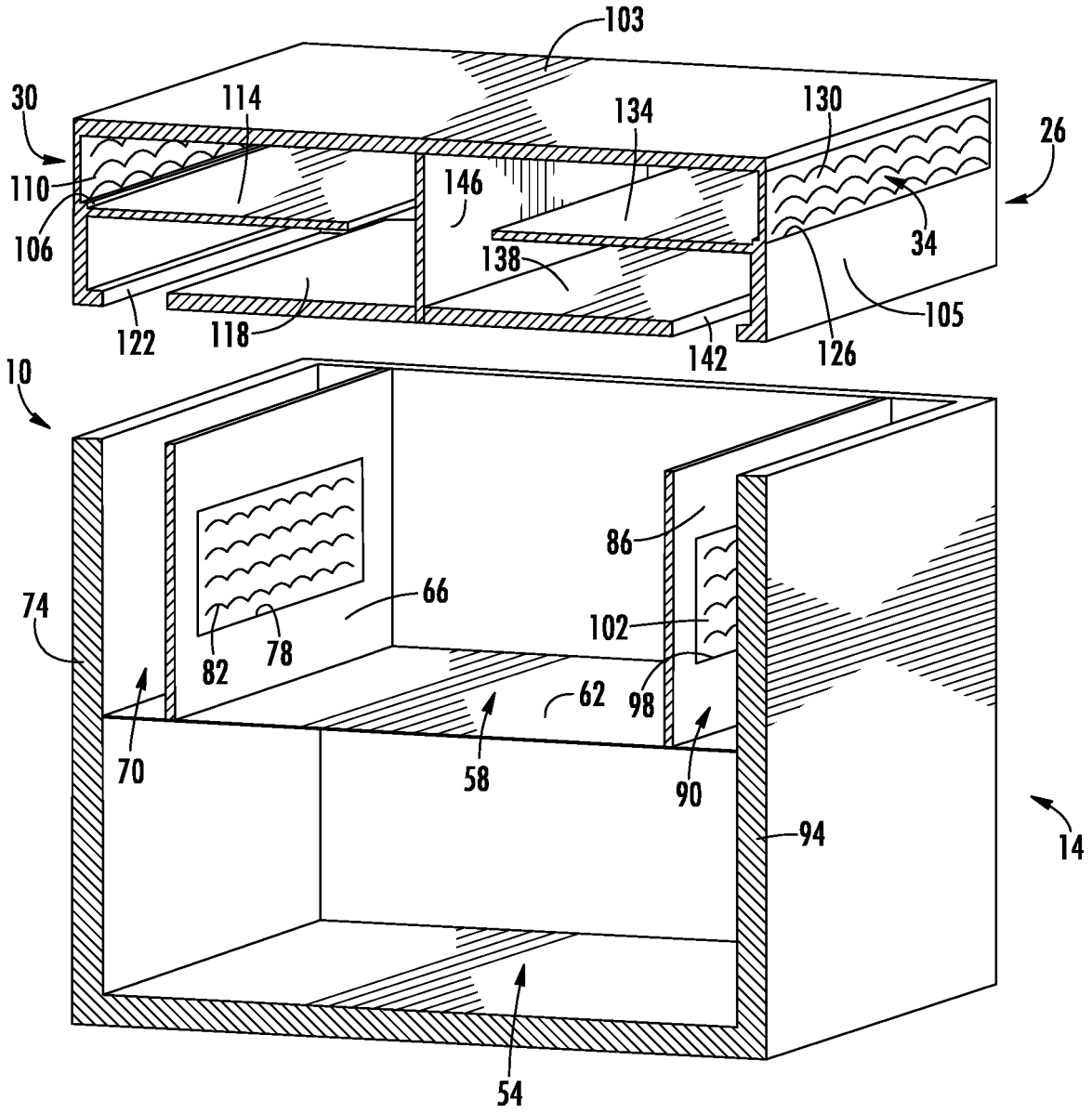
FIG. 5B is a partially exploded section view of the generator set of FIG. 1A taken along a line 4-4 of FIG. 1A with generator set components removed.

As shown in FIG. 5B, the modular canopy 26 is a separate component from the enclosure 14. In some embodiments, the enclosure 14 originally includes the enclosure roof 148 for shipping and or component protection. The enclosure roof 148 is then removed, or, alternatively, left in place, and the modular canopy 26 coupled to the enclosure 14 to cover the entire enclosure 14. The intake 30 and the exhaust 34 extend substantially the full width of the enclosure 14 and modular canopy 26. Utilizing substantially the entire width of the enclosure 14 and modular canopy 26 allows the height of the modular canopy 26 to be reduced while still providing the required airflow for the intake 30 and the exhaust 34. The modular canopy 26 provides intake and exhaust features on a roof or top portion of the generator set 10 as opposed to the more typical end placement of intake and exhaust on the walls or sides of generator set enclosures. Although shown in FIGS. 1-6 as extending along a substantially entire width of the enclosure 14, the modular canopy 26 can extend along a portion of the enclosure 14. For example, in some embodiments, the modular canopy 26 extends along at least eighty percent (80%) of the width of the enclosure 14. Likewise, the canopy intake aperture 106, the canopy intake baffle 114, the canopy intake floor 118 and the canopy intake exit aperture 122 may extend along at least eighty percent (80%) of the width of the enclosure 14, or along at least eighty percent (80%) of the width of the modular canopy 26. Further, the canopy exhaust aperture 126, the canopy exhaust baffle 134, the canopy exhaust floor 138, and the canopy exhaust entrance aperture 142 may extend along at least eighty percent (80%) of the width of the enclosure 14, or along at least eighty percent (80%) of the width of the modular canopy 26.

Figure 6:
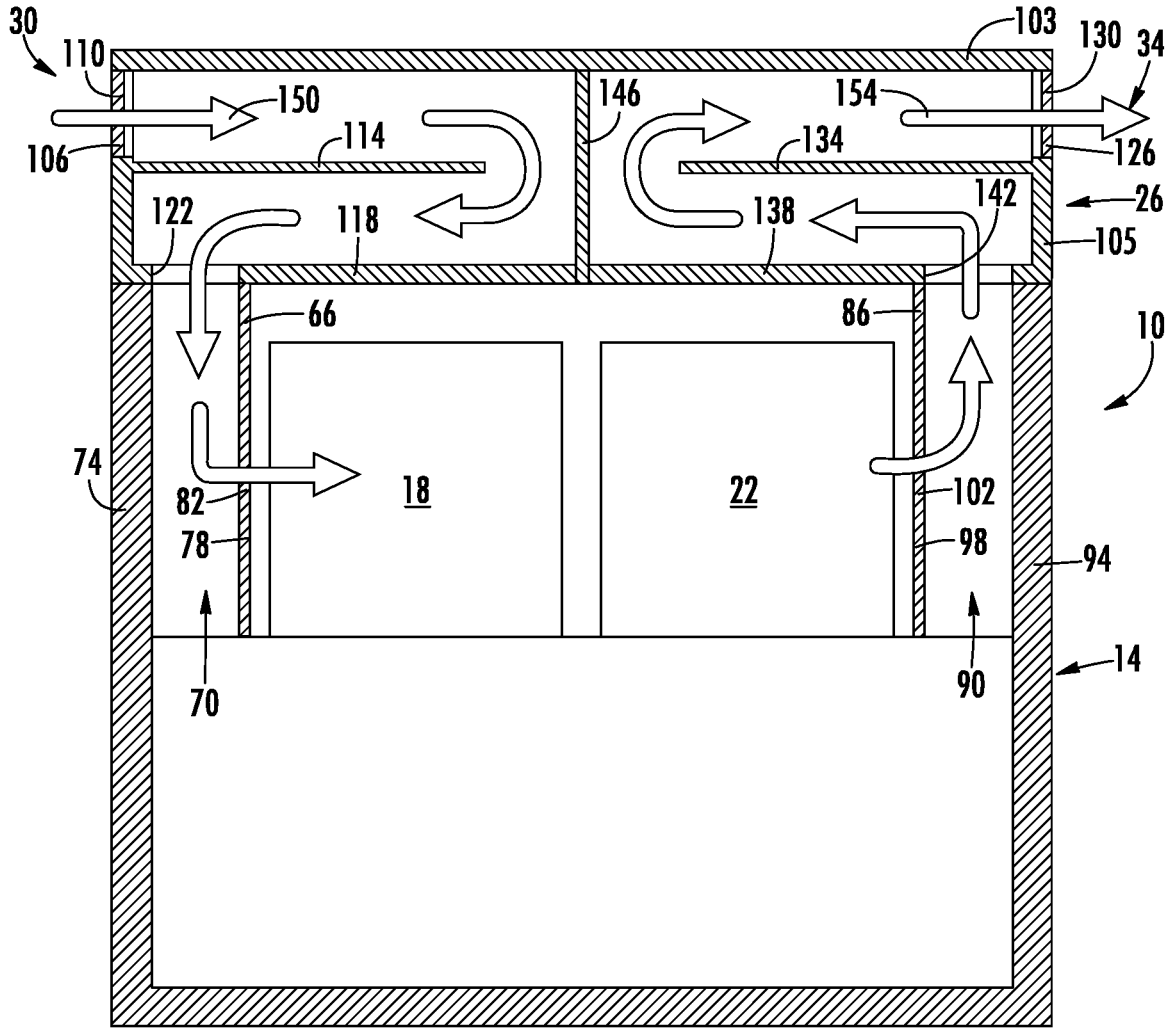
FIG. 6 is a section view of the generator set of FIG. 1A taken along a line 4-4 of FIG. 1A.

As shown in FIG. 6, an intake airflow path 150 follows a circuitous path that is indicated by arrows and flows from the canopy intake aperture 106, across the canopy intake baffle 114 to the partition panel 146, across the canopy intake floor 118 to the canopy intake exit aperture 122, into the enclosure intake cavity 70, and through the enclosure intake aperture 78 to the second chamber 58, the engine 18, and/or one or more components 22. An exhaust flow path 154 follows a circuitous path to baffle noise and prevent line of sight noise transmission from the source that is indicated by arrows and flows from the enclosure exhaust aperture 98 to the enclosure exhaust cavity 90, through the canopy exhaust entrance aperture 142, across the canopy exhaust floor 138 to the partition panel 146, across the canopy exhaust baffle 134, and out the canopy exhaust aperture 126. The partition panel 146 isolates the intake 30 from the exhaust 34. In this application, "circuitous" means a path that travels in a first direction, then later in at least one place travels in a second direction that is substantially opposite the first direction. In the illustrated embodiment, the intake air flow path 150 flows to the right in FIG. 6 on a top side of the intake baffle 114, then to the left on a bottom side of the intake baffle 114. In some embodiments, the flow paths are reversed from those shown. In other words, components could be rearranged to provide a circuitous path in the second direction, then the first direction, or in other directions oblique to the first and second directions.

Acoustic barrier and/or absorbtive material may advantageously be added in strategic positions within the intake 30, the exhaust 34, and/or with the second chamber 58 to absorb and damp sound to further reduce noise emissions. In some embodiments, the acoustic barrier material is adhered or attached to surfaces of the canopy intake baffle 114, the canopy intake floor 118, the enclosure intake cavity 70, the second chamber 58, the enclosure exhaust cavity 90, the canopy exhaust floor 138, the canopy exhaust baffle 134, the partition 146, or any combination of locations. In some embodiments, more than one type of acoustic barrier material is used. For example, heat resistant acoustic barrier material may be installed within the enclosure exhaust cavity 90 where high heat may be a concern. In some embodiments, acoustic barrier material is bonded to all the surfaces within the modular canopy 26 to reduce noise emission from the intake 30 and the exhaust 34.

The low noise enclosure system reduces noise emissions to sixty-five A-weighted decibels (65 dB(A)) or less at one meter (1 m) and provides a low cost, and simple to implement solution. The modular canopy 26 can be retrofitted to existing enclosures and provide the noise emission reduction benefits.

Applicant has identified that noise quality affects the perceived loudness of noise emissions. In this case, noise quality is defined by a frequency or frequency range. The low noise enclosure system can be tuned to reduce undesirable frequencies or frequency ranges and improve the noise quality. The dimensions of the modular canopy 26 including the width of the canopy intake baffle 114 and the canopy exhaust baffle 134, the height of the partition panel 146, the size of the canopy intake aperture 106 and the canopy exhaust aperture 126, and other dimensional components can be altered in order to tune the system to avoid or reduce undesirable frequencies. Additionally, the modular canopy 26 can be constructed with relatively thin material. In some embodiments, the modular canopy includes a frame that is covered in sheet metal. In some embodiments, the sheet metal defines a 1.6 millimeter (1.6 mm) or greater thickness. In some embodiments, the sheet metal is about three millimeters (3 mm) thick. In some embodiments, the sheet metal is less than six millimeters (6 mm) thick. In some embodiments, a 10-16 gauge sheet metal is used. Both ferrous and non-ferrous metals and alloys may be suitable in addition to non-metallic materials such as fiberglass, molded plastic, and glass reinforced plastics.

No claim element herein is to be construed under the provisions of 35 U.S.C. § 112(f), unless the element is expressly recited using the phrase "means for."

For the purpose of this disclosure, the term "coupled" means the joining or linking of two members directly or indirectly to one another. Such joining may be stationary or moveable in nature. For example, a propeller shaft of an engine "coupled" to a transmission represents a moveable coupling. Such joining may be achieved with the two members or the two members and any additional intermediate members.

The foregoing description of embodiments has been presented for purposes of illustration and description. It is not intended to be exhaustive or to limit the disclosure to the precise form disclosed, and modifications and variations are possible in light of the above teachings or may be acquired from this disclosure. The embodiments were chosen and described in order to explain the principals of the disclosure and its practical application to enable one skilled in the art to utilize the various embodiments and with various modifications as are suited to the particular use contemplated. Other substitutions, modifications, changes and omissions may be made in the design, operating conditions and arrangement of the embodiments without departing from the scope of the present disclosure as expressed in the appended claims.

Accordingly, the present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. A system, comprising:

an enclosure for a generator set defining an enclosure width and including a first enclosure wall extending the entire enclosure width, an enclosure intake wall that extends along at least eighty percent (80%) of the enclosure width, an enclosure intake cavity defined between the first enclosure wall and the enclosure intake wall, a second enclosure wall positioned on an opposite side of the enclosure from the first enclosure wall and extending the entire enclosure width, an enclosure exhaust wall that extends along at least eighty percent (80%) of the enclosure width, an enclosure exhaust cavity defined between the second enclosure wall and the enclosure exhaust wall, and a chamber defined between the enclosure intake wall and the enclosure exhaust wall; and a modular canopy defining a canopy width that extends along at least eighty percent (80%) of the enclosure width, and including a canopy intake defined by an intake aperture, an intake baffle, and an intake floor structured to couple to the enclosure to provide fluid communication between the intake aperture and the enclosure intake cavity, the canopy intake extending along substantially the entire canopy width adjacent the first enclosure wall, a canopy exhaust defined by an exhaust aperture, an exhaust baffle, and an exhaust floor structured to couple to the enclosure to provide fluid communication between the exhaust aperture and the enclosure exhaust cavity, the canopy exhaust extending along substantially the entire canopy width adjacent the second enclosure wall, and a partition panel isolating the canopy intake from the canopy exhaust.

2. The system of claim 1, wherein the modular canopy is separate from the enclosure and structured to couple to the enclosure.

3. The system of claim 1, wherein the canopy intake defines a circuitous intake flow path around the intake baffle, and the canopy exhaust defines a circuitous exhaust flow path around the exhaust baffle.

4. The system of claim 1, wherein the system reduces noise emission levels to about sixty-five A-weighted decibels (65 dB(A)) or less at about one meter (1 m).

5. The system of claim 1, wherein the modular canopy is constructed using sheet metal with a thickness between about two millimeters (2 mm) and about six millimeters (6 mm).

6. The system of claim 1, wherein the modular canopy replaces an original roof of the enclosure.

7. The system of claim 1, wherein the enclosure further includes a single point lifting hook positioned within a lifting cavity, and a cover structured to selectively seal the lifting cavity to inhibit noise emission from the lifting cavity.

8. The system of claim 1, further comprising an acoustic barrier material applied to the canopy intake and the canopy exhaust.

9. The system of claim 1, wherein the canopy width extends substantially the entire enclosure width.

10. A method, comprising:

removing a roof of a generator set enclosure, the generator set enclosure including a first enclosure wall extending an entirety of an enclosure width, an enclosure intake wall that extends along at least eighty percent (80%) of the enclosure width, an intake cavity defined between the first enclosure wall and the enclosure intake wall, a second enclosure wall positioned on an opposite side of the enclosure from the first enclosure wall and extending along the entirety of the enclosure width, an enclosure exhaust wall that extends along at least eighty percent (80%) of the enclosure width, an exhaust cavity defined between the second enclosure wall and the enclosure exhaust wall, and a chamber defined between the enclosure intake wall and the enclosure exhaust wall;

coupling a modular canopy to the generator set enclosure, the modular canopy defining a canopy width that extends along at least eighty percent (80%) of the enclosure width;

providing an intake flow path extending along at least eighty percent (80%) of of the enclosure width through the coupled modular canopy and the generator set enclosure, wherein the intake flow path includes an intake aperture positioned in the modular canopy, an intake baffle positioned in the modular canopy, an intake floor positioned in the modular canopy structured to couple to the generator set enclosure to provide fluid communication between the intake aperture and the intake cavity, and the intake cavity positioned in the generator set enclosure, the intake flow path extending along substantially the entire canopy width adjacent the first enclosure wall;

providing an exhaust flow path extending along at least eighty percent (80%) of the enclosure width through the coupled modular canopy and the generator set enclosure, the exhaust flow path includes an exhaust aperture positioned in the modular canopy, an exhaust baffle positioned in the modular canopy, an exhaust floor positioned in the modular canopy structured to couple to the generator set enclosure to provide fluid communication between the exhaust aperture and the exhaust cavity, and the exhaust cavity positioned in the generator set enclosure, the exhaust flow path extending along substantially the entire canopy width adjacent the second enclosure wall; and separating the intake flow path and the exhaust flow path with a partition panel.

11. The method of claim 10, wherein the intake flow path defines a circuitous intake flow path around the intake baffle, and the exhaust flow path defines a circuitous exhaust flow path around the exhaust baffle.

12. The method of claim 10, further comprising lifting the generator set enclosure via a single point lifting hook arranged in a lifting cavity, and covering the lifting cavity with a cover.

13. The method of claim 10, wherein the intake flow path is provided on a first side of the generator set enclosure and the modular canopy and the exhaust flow path is provided on a second side opposite the first side.

14. The method of claim 10, further comprising constructing the modular canopy from sheet metal with a thickness between about two millimeters (2 mm) and about six millimeters (6 mm).

15. The method of claim 10, further comprising operating a generator set positioned within the generator set enclosure and measuring a noise emission of about sixty-five A-weighted decibels (65 dB(A)) or less at about one meter (1 m).

* * * * *